US005462375A

United States Patent [19]

Isobe et al.

[11] Patent Number: 5,462,375

[45] Date of Patent: Oct. 31, 1995

[54] PRINTER AND DATA PROCESSING APPARATUS HAVING PRINTING UNIT

[75] Inventors: Minoru Isobe; Koutaro Yoshimura; Shigemi Togashi, all of Tokyo, Japan

[73] Assignee: Oki Electric Industry Co., Ltd., Tokyo, Japan

[21] Appl. No.: 236,916

[22] Filed: Apr. 29, 1994

[30] Foreign Application Priority Data

May 17, 1993 [JP] Japan ..... 5-114680

[51] Int. Cl.[6] ..... B41J 29/02

[52] U.S. Cl. ..... 400/680; 400/88; 400/693; 361/680; 361/681; 347/108

[58] Field of Search ..... 400/88, 680, 681, 400/682, 683, 684, 685, 693; 347/108, 109; 346/145; 361/680, 681, 683, 724; 364/708.1

[56] References Cited

U.S. PATENT DOCUMENTS

| | | | |
|---|---|---|---|
| 2,540,297 | 2/1951 | Freeman et al. | 400/693 X |
| 4,725,157 | 2/1988 | Nakai et al. | 400/88 X |
| 5,312,196 | 5/1994 | Hock et al. | 400/88 X |

FOREIGN PATENT DOCUMENTS

| | | | |
|---|---|---|---|
| 0540301 | 5/1993 | European Pat. Off. | 347/108 |
| 0272880 | 9/1992 | Japan | 400/88 |
| 0272874 | 9/1992 | Japan | 400/88 |
| 0282253 | 10/1992 | Japan | 347/108 |
| 0334476 | 11/1992 | Japan | 400/680 |

*Primary Examiner*—Chris A. Bennett

*Attorney, Agent, or Firm*—Panitch Schwarze Jacobs & Nadel

[57] ABSTRACT

A printer having a printer body and a print unit is disclosed. The printer body has an upper surface that supports a sheet in a horizontal plane and a drive roller below the horizontal plane. The print unit has a print head and a driven roller and rotates about the drive roller. The print unit is rotatable to printing and non-printing positions in which the printing unit is above and below the horizontal plane, respectively. A data processing apparatus having a printing unit with a print head, a display unit with a cover and display, and an input body with an upper surface that defines a horizontal plane is also disclosed. The display unit is rotatable to open and closed positions. The printing unit is above the horizontal plane in a printing position when the display unit is in the open position and below the horizontal plane in a non-printing position when the display unit is in the closed position. In the printing position, the print head is in a first orientation, and in the non-printing position, the print head is in a second orientation at about a right angle with respect to the first orientation.

5 Claims, 9 Drawing Sheets

PRINTER AND DATA PROCESSING APPARATUS HAVING PRINTING UNIT

BACKGROUND OF THE INVENTION

1. Field of the Invention

The present invention relates to a structure of a printer and a structure of a data processing apparatus having a printing unit, particularly relates to a structure of a horizontal type printer for printing on a printing medium while feeding the printing medium horizontally and a structure of a data processing apparatus having a horizontal type printing unit.

2. Description of the Related Art

Meeting the demands of users for personal use printers of low priced printers, there have been provided printers each structure of which is stressed on making the printer small in size, low in price and high in printing quality. However, these printers are placed under various restricting conditions, e.g. in a size, thickness or kind of a printing medium. If these printers are used for a business purpose, they are limited in their use. To relax these restricting conditions, there has been developed a horizontal type printer which can move a printing medium horizontally and print on the printing medium by a print head attached to the printer above a surface of the traveling printing medium. Since the printing medium is fed horizontally in this kind of printer, the printing medium is less curled or skewed. Accordingly, this printer has an effect that it can print on a small printing medium such as a thick paper or a check. However, there are problems to be solved in this horizontal type printer so that it can be more widely used by users as a printer adapted for a business use while meeting the demand of a personal use. In the prior art horizontal printer, a print head portion is always positioned above the printer body. Accordingly, there was a problem in that the printer is poorly accommodated since the upper portion of the printer projects even in a non-printing operation state. In an ink jet type print head, there is an additional problem to be solved. A print head of the prior art ink jet type horizontal printer is always mounted on the printer in a downward direction. Accordingly, if the printer is left unused for a long period of time, there was a problem in that ink drops from the print head to thereby stain the printing medium or a printing paper traveling path.

The problem of the poor accommodation of the printer because of the projection of the upper portion of the printer even in the non-printing operation state was also kept unsolved in a data processing apparatus having a prior art horizontal printing unit.

If the data processing apparatus is left unused for a long period of time, the problem that ink drops from the print head to thereby stain the printing medium or printing paper traveling path was also kept unsolved in the data processing apparatus having the prior art horizontal printing unit.

SUMMARY OF THE INVENTION

It is a first object of the invention to provide a horizontal type printer or a data processing apparatus having a horizontal printing unit which is made compact in a non-printing operation state. It is another object of the invention to provide a horizontal type printer or a data processing apparatus having a horizontal printing unit which does not stain a printing medium or a printing paper traveling path even if the printer or the data processing apparatus has been left unused for a long period of time.

To achieve the first object of the invention, the horizontal type printer or the data processing apparatus having the horizontal printing unit comprises a feeding means for feeding a printing paper in a substantially horizontal direction, a print head for printing on the printing paper, which is fed by the feeding means, at the position above the printing paper, a drive means for driving the feeding means, and a control means for controlling the drive means and the print head wherein the print head and a printing unit including at least a part of the fee,fling means are movable relative to a printer body.

The printing unit is positioned above the printer body in a printing operation time or state while it is positioned under an upper surface of the printer body in a non-printing operation state. The movement of the printing unit to both positions may be performed by rotary or linear motion thereof.

According to the present invention, since the printing unit is structured to be positioned under the upper surface of the printer body in the non-printing operation state, the printer or the data processing apparatus can be made compact. Furthermore, since the printing unit is moved to the position under the upper surface of the printer body by the rotary motion thereof in the non-printing operation state, the printing unit is in the horizontal state in the non-printing operation state. With such an arrangement, there does not occur the problem in that ink drops from the print head to thereby stain the printing medium or printing paper traveling path even if the print head is the ink jet type one.

PREFERRED EMBODIMENT OF THE INVENTION

First Embodiment

FIGS. 1 to 9

A printer 1 of the first embodiment will be described with reference to FIGS. 1 to 9.

Figure 2:
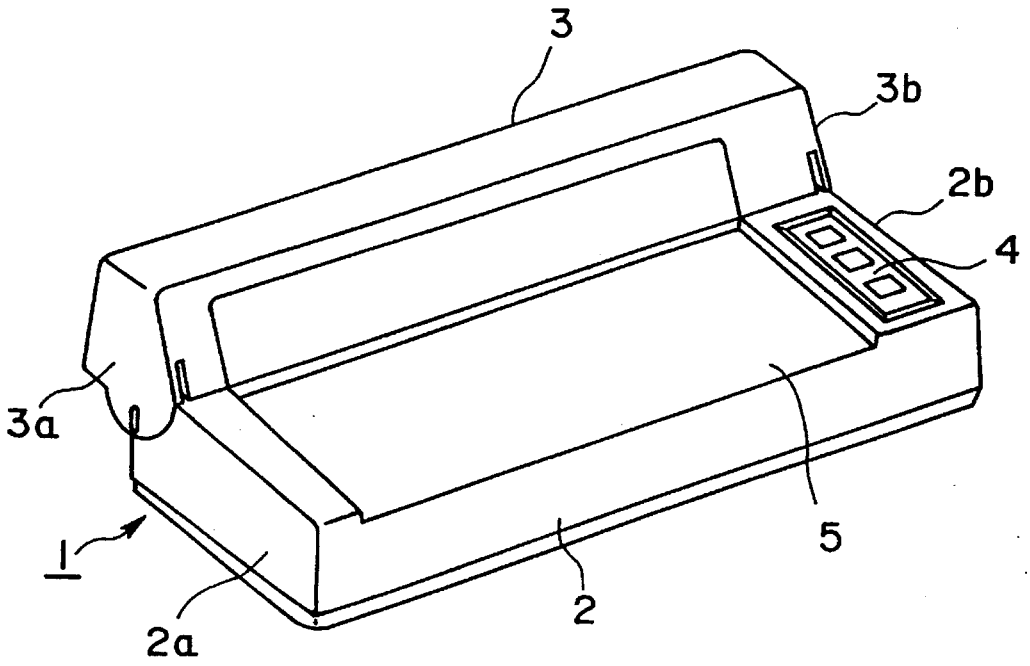
FIG. 2 shows an external appearance of the printer in FIG. 1 when it is in a printing operation state.

In FIG. 2, the printer 1 comprises a printer body 2 and a printing unit 3 which is mounted on the printer body 2 so as to be turned relative to the printer body 2. The printer body 2 includes an operation portion 4 for performing various functions of the printer and a set table 5 for setting a printing paper thereon.

Figure 1:
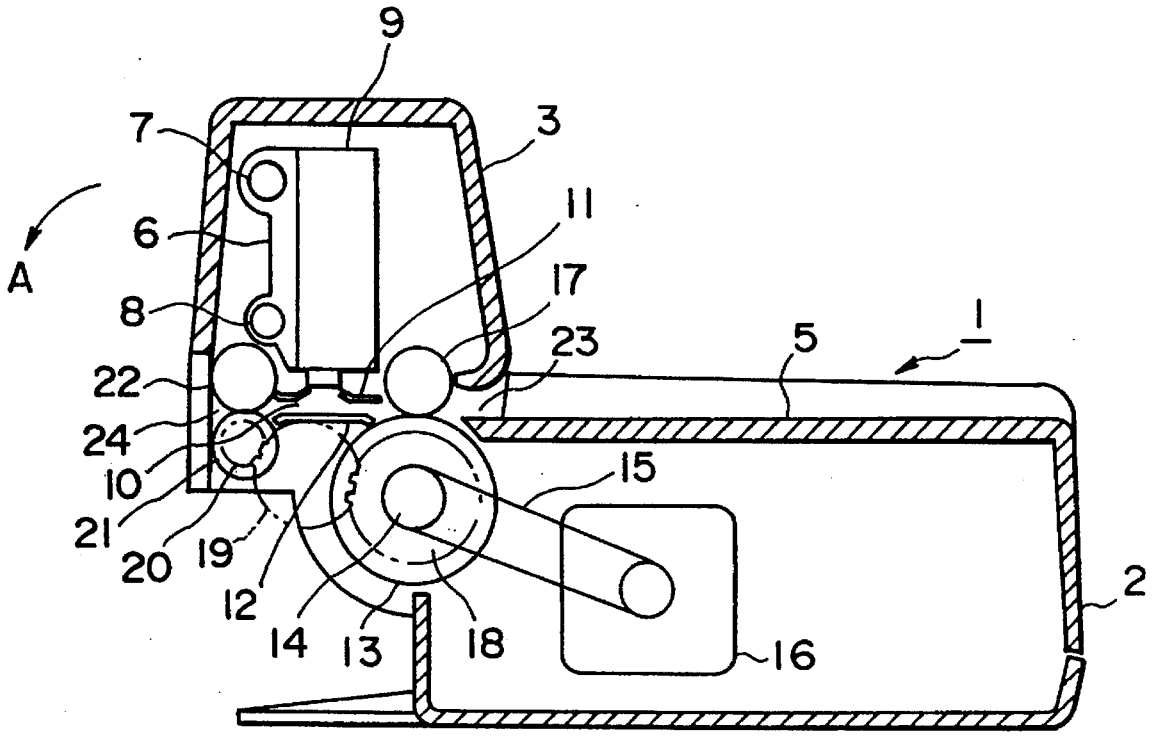
FIG. 1 is a schematic cross-sectional view of a printer according to a first embodiment of the invention.

FIG. 1 shows schematically various internal elements which are housed in the printer 1. A carriage 6 is provided in the printing unit 3 and it is supported by a guide shaft 7 and a lead screw 8 so as to be movable in a spacing direction. An ink jet type print head 9 is mounted on the carriage 6 in the downward direction. The guide shaft 7 is rotatably supported at the both ends thereof by side frames 3*a* and 3*b* of the printing unit 3. The lead screw 8 is rotated by a carriage motor, not shown. The carriage 6 is moved together with the print head 9 in the spacing direction when the lead screw 8 rotates. There is provided a feed path 10 under the print head 9. There are provided an upper sheet guide 11 and a lower sheet guide 12 on the feed path 10. There are provided a first feed roller 13 and a first pressure roller 17 in front of the feed path 10 for feeding the printing paper toward the print head 9. There are provided a second feed roller 21 and a second pressure roller 22 at the rear of the feed path 10 for feeding and discharging the printing paper from the feed path 10. The first feed roller 13 is mounted on a shaft 14. The shaft 14 is rotatably supported at both ends thereof by the side frames 3*a* and 3*b* of the printing unit 3 and side frames 2a and 2b of the printer body 2 (refer to FIG. 2). A belt 15 is entrained around a pulley, not shown, of the shaft 14 and a pulley, not shown, of a feed motor 16 provided on the printer body 2. The belt 15 is driven by the feed motor 16.

The first pressure roller 17 is pressed against the first feed roller 13 by a spring, not shown. A gear 18 is fixed to the shaft 14. The gear 18 meshes a gear 19 and the gear 19 meshes a gear 20. The gear 20 is fixed to a shaft, not shown, to which the second feed roller 21 is fixed. The second pressure roller 22 is pressed against the second feed roller 21, by a spring, not shown. A paper inserting slit 23 is formed between the first pressure roller 17 and the first feed roller 13 at the portion where the former is pressed against the latter at the right side in FIG. 1. A paper discharging slit 24 is formed between the second pressure roller 22 and the second feed roller 21 at the portion where the former is pressed against the latter at the left side in FIG. 1.

Figure 3:
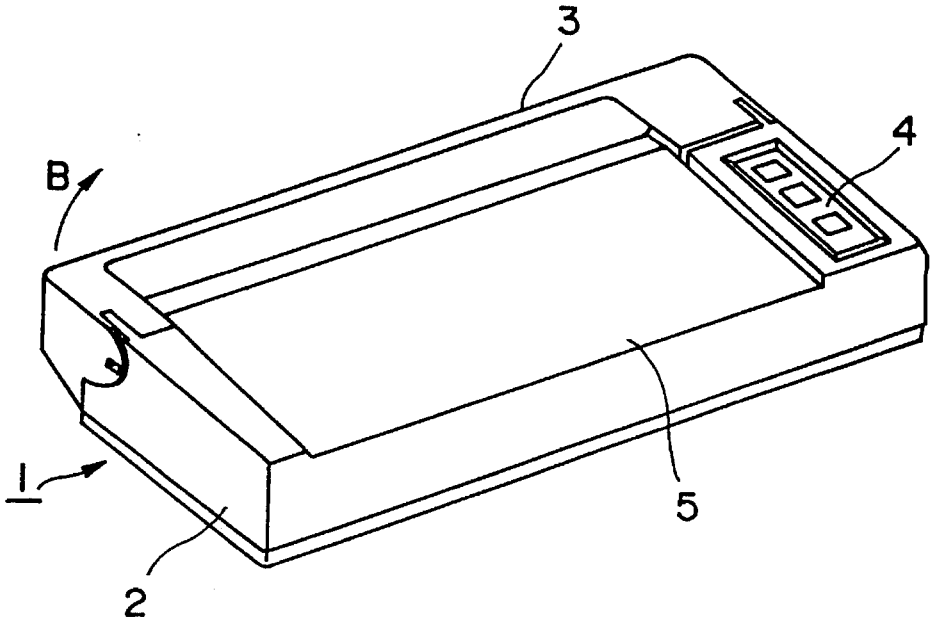
FIG. 3 shows the external appearance of the printer in FIG. 1 when it is in a non-printing operation state.

The printing unit 3 is structured to be turned about the shaft 14. When the printing unit 3 is turned substantially at an angle of 90° from a state as illustrated in FIG. 1 (printing operation state) in the direction of an arrow A, it is changed into a state as illustrated in FIG. 3 (non-printing operation state). In the state where the printing unit 3 is positioned at the side surface of the printer body 2 as illustrated in FIG. 3, the print head 9 is directed sideways.

A retaining mechanism 70 for retaining the printing unit 3 on the printer body 2 in a given state will be described with reference to FIGS. 4 and 5.

Figure 4:
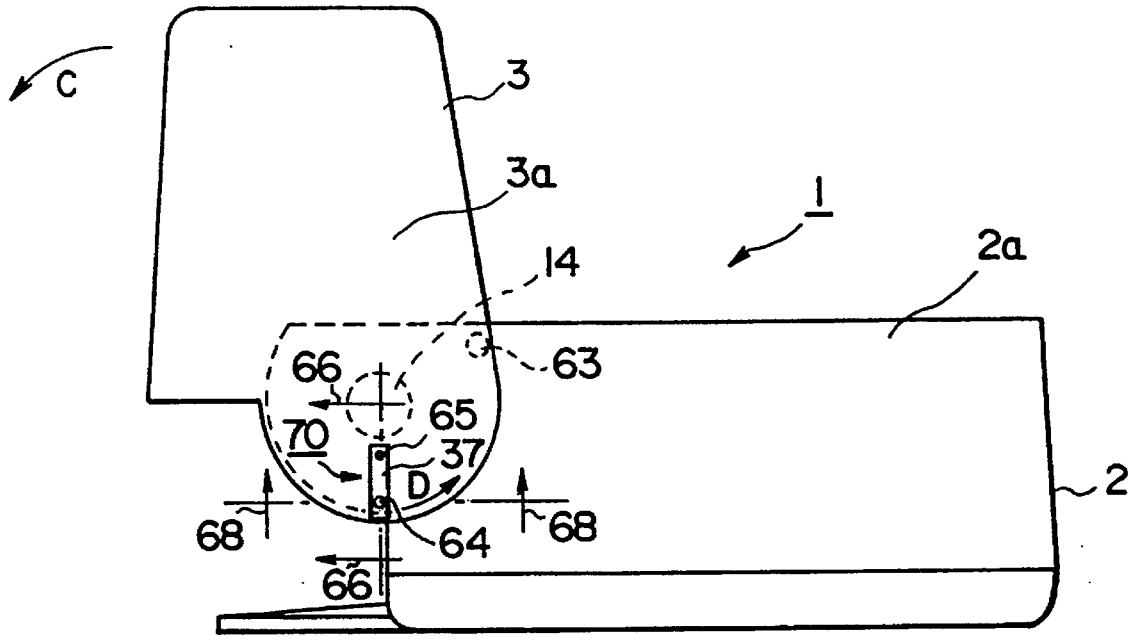
FIG. 4 is a side view of the printer in FIG. 1.

In FIG. 4, a side frame 2a of the printer body 2 has a lower retaining hole 64 for retaining the printing unit 3 in the state as illustrated in FIG. 2 (printing operation state) and an upper retaining hole 63 for retaining the printing unit 3 in the state as illustrated in FIG. 3 (non-printing operation state). The retaining mechanism 70 is attached to a side frame 3*a* of the printing unit 3 and has a mechanism for retaining the printing unit 3 on the printer body 2 by engaging in the lower retaining hole 64 when the printing unit 3 moves to the position as illustrated in FIG. 2 while engaging in the upper retaining hole 63 when the printing unit 3 moves to the position as illustrated in FIG. 3.

The lower retaining hole 64 and the retaining mechanism 70 will be described more in detail with reference to FIG. 5.

Figure 5:
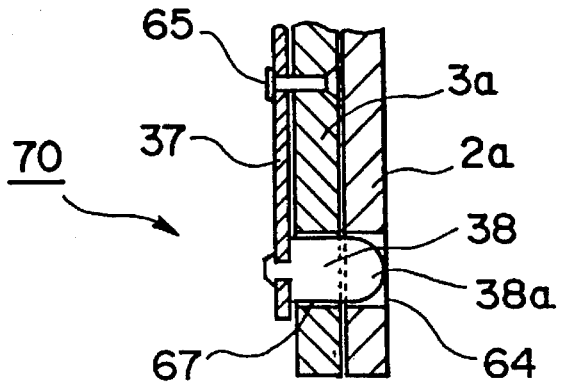
FIG. 5 is a partially enlarged cross-sectional view taken along the line V—V in FIG. 4.

In FIG. 5, the retaining mechanism 70 comprises a leaf spring 37, a projection 38 and a guide hole 67 having such a size that the projection 38 can be inserted therethrough into the side frame 3*a* of the printing unit 3. The leaf spring 37 is fixed to an outer surface of the side frame 3*a* of the printing unit 3 by a screw 65. The projection 38 is attached to the tip end of the leaf spring 37. The projection 38 has a hemispherical tip end portion 38*a*. The projection 38 is inserted into the guide hole 67 so that the tip end portion 38*a* projects toward the inner side of the side frame 3*a* of the printing unit 3. In the printing operation state as illustrated in FIG. 2, the tip end portion 38*a* which projects toward the inner side of the side frame a engages in the lower retaining hole 64 as illustrated in FIG. 5 so as to retain the printing unit 3 on the printer body 2. In the non-printing operation state as illustrated in FIG. 3, the tip end portion 38*a* engages in the upper retaining hole 63 so as to retain the printing unit 3 on the printer body 2.

Figure 7:
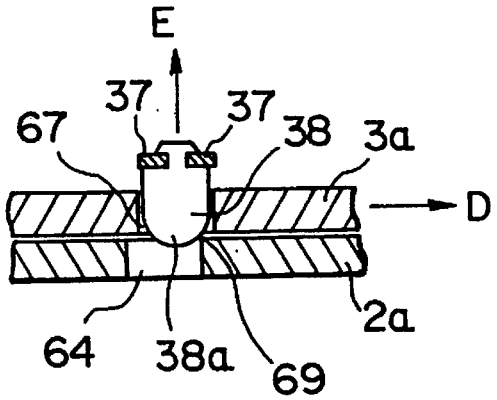
FIG. 7 is a cross-sectional view of the retaining mechanism in FIG. 6, showing how the retaining mechanism is operated.
Figure 8:
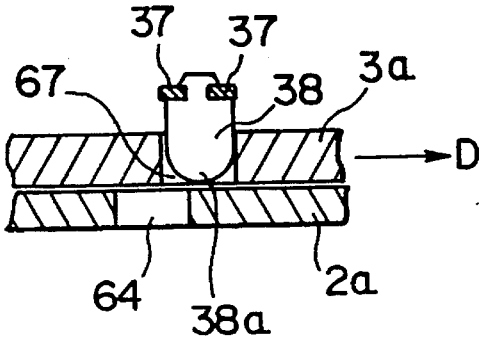
FIG. 8 is a cross-sectional view of the retaining mechanism in FIG. 6, showing how the retaining mechanism is released from its retaining operation.

An operation of the retaining mechanism 70 will be described with reference to FIGS. 6 to 8 wherein it moves the printing unit 3 from the printing operation state as illustrated in FIG. 2.

Figure 6:
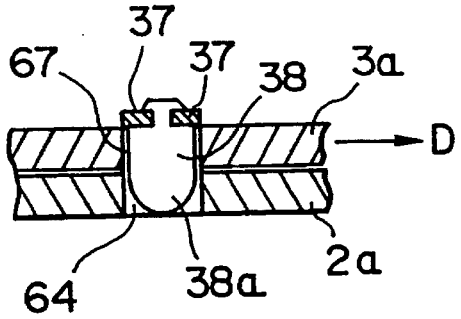
FIG. 6 is a partly exploded cross-sectional view taken along the line VI—VI in FIG. 4, showing how a retaining mechanism retains a printing unit on a printer body.

In FIG. 6, the tip end portion 38*a* projecting toward the inner side surface of the side frame 3*a* engages in the lower retaining hole 64 so as to retain the printing unit 3 on the printer body 2 in the printing operation state as illustrated in FIG. 2. When the printing unit 3 is turned about the shaft 14 in the direction of an arrow C, the projection 38 fixed to the leaf spring 37 is moved in the direction of an arrow D while guided along the guide hole 67 as illustrated in FIGS. 6 to 8. In FIG. 7, when the projection 38 is moved in the direction of the arrow D, the tip end portion 38*a* rises on a tip end 69 of the lower retaining hole 64. When the tip end portion 38*a* rises on the tip end 69, the projection 38 is pushed upward in the direction of an arrow E against the resilient force of the leaf spring 37. When the projection 38 moves further in the direction of the arrow D, the tip end portion 38*a* is got out from the lower retaining hole 64 as illustrated in FIG. 8, whereby the printing unit 3 is released from the state where it is retained on the printer body 2 as illustrated in FIGS. 2 and 4.

When the printing unit 3 is moved from the printing operation state as illustrated in FIG. 2 to the non-printing operation state as illustrated in FIG. 3, the tip end portion 38*a* is moved while it is pressed against and slid along the outer side surface of the side frame 2*a* by the resilient force of the leaf spring 37. When the printing unit 3 is moved to the non-printing operation state as illustrated in FIG. 3, the tip end portion 38*a* of the projection 38 engages in the upper retaining hole 63 so as to retain the printing unit 3 on the printer body 2. An operation of the retaining mechanism 70, when the printing unit 3 is released from the nonprinting operation state as illustrated in FIG. 3, is omitted to explain since it is the same as the one when the printing unit 3 is released from the printing operation state as illustrated in FIG. 2.

A control unit of the first embodiment will be described with reference to FIG. 9.

Figure 9:
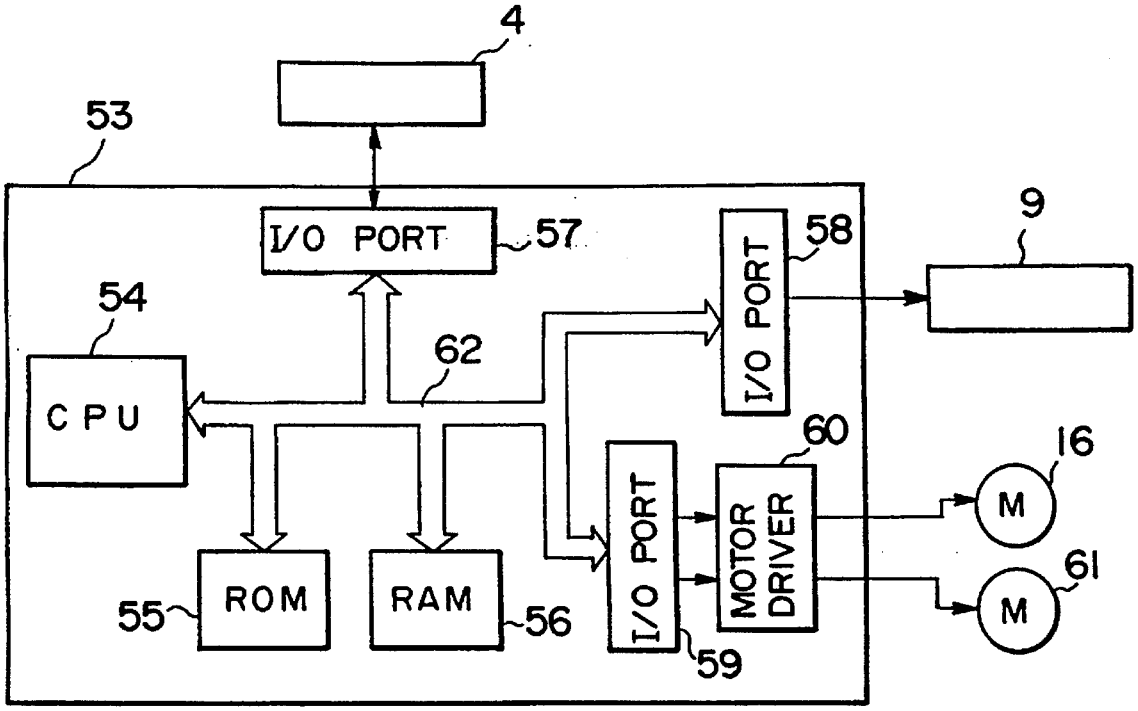
FIG. 9 is a block diagram showing a control unit of the printer in FIG. 1.

In FIG. 9, a control unit 53 controls an entire operation of the printer 1. The control unit 53 comprises a CPU (Central Processing Unit) 54 for controlling the operation, a ROM (Read Only Memory) 55 for storing a running program of the CPU 54, a RAM (Random Access Memory) 56 for temporarily storing data, I/O ports 57, 58 and 59 and a motor driver 60 which is controlled by the CPU 54 by way of the I/O port 59. These elements are connected with one another by a common bus 62. The I/O port 57 is connected to the operation portion 4 and receives a signal supplied by the operation portion 4. The I/O port 58 is connected to the print head 9 for supplying printing data to the print head 9. The I/O port 59 is connected to the motor driver 60 for supplying a control signal issued from the CPU 54 to the motor driver 60. The motor driver 60 rotates a carriage motor 61 for moving the carriage 6 and the feed motor 16 as illustrated in FIG. 1. The control unit 53 is mounted on a substrate, not shown, provided inside the printer body 2.

An operation of the printer 1 having the aforementioned structure will be described hereinafter.

In the non-printing operation state, the printer 1 is positioned in the state as illustrated in FIG. 3. That is, the printing unit 3 is positioned abreast of the printer body 2. The printing unit 3 is turned about the shaft 14 in the direction of an arrow B from the state as illustrated in FIG. 3. When the printing unit 3 is turned about the shaft 14, the gear 19 is turned around the gear 18 fixed to the shaft 14 while meshing the gear 18. When the printing unit 3 is turned substantially at an angle of 90°, the printing unit 3 is kept in the printing operation state as illustrated in FIG. 2. With such an arrangement, when the printing unit 3 is moved relative to the printer body 2, a positional relation between the feed motor 16 and the gear 18 is maintained. Furthermore, a positional relation between the gear 18, the gear 19 and the gear 20 is also maintained. Since a driving force transmission mechanism is structured in such a manner that the printing unit 3 is movable relative to the printer body 2, it is possible to prevent problems such as a poor driving force transmission which is likely to occur.

The printing paper is set on the set table 5 of the printer body 2 in the printing operation state as illustrated in FIG. 2. The printing paper is set in the manner that the tip end of the printing paper is brought into contact with a portion where the first pressure roller 17 is pressed against the first feed roller 13 as illustrated in FIG. 1. When the operation portion 4 is operated, a print starting signal is supplied to the I/O port 57 as illustrated in FIG. 9. The CPU 54 receives the print starting signal by way of the I/O port 57. The CPU 54 supplies, upon reception of the print starting signal, an instruction for rotating the feed motor 16 to the motor driver 60 by way of the I/O port 59. When the feed motor 16 is rotated counterclockwise in FIG. 1, the first and second feed rollers 13 and 21 are rotated counterclockwise. When the first feed roller 13 is rotated, the printing paper is fed leftward in FIG. 1. When the printing paper passes between the upper sheet guide 11 and the lower sheet guide 12 and reaches the print head 9, the rotation of the feed motor 16 is stopped by the control of the control unit 53.

In this state, the control unit 53 supplies the printing data to the print head 9 and at the same time it drives the carriage motor 61 so as to move the carriage 6 so that one line printing data is printed on the printing paper.

The control unit 53, upon completion of the printing of one line printing data on the printing paper, rotates the first feed roller 13 again so as to feed the printing paper by a given amount so that next printing data can be printed on the printing paper. The printer 1 repeats these operations so as to print the printing data on the printing paper.

When the printing operation advances further, a tip end of the printing paper reaches the portion where the second pressure roller 22 is pressed against the second feed roller 21. Since the second feed roller 21 is rotated in synchronization with the first feed roller 13, the printing paper is fed by the second feed roller 21 and the second pressure roller 22 as well as by the first feed roller 13 and the first pressure roller 17. When the printing operation advances more further, a rear end of the printing paper passes through the portion where the first pressure roller 17 is pressed against the first feed roller 13. Thereafter, the printing paper is fed only by the second feed roller 21 and the second pressure roller 22. The printing paper is discharged from the paper discharge slit 24 toward the rear portion of the printer 1 by the second feed roller 21 and the second pressure roller 22 upon completion of the printing operation.

When the printing operation is not performed, the printing unit 3 is turned about the shaft 14 substantially at an angle of 90° in the direction of the arrow C as illustrated in FIG. 2. The printing unit 3 is positioned abreast of the printer body 2 as illustrated in FIG. 3. When the printing unit 3 is positioned abreast of the printer body 2, the printer 1 can be made compact like a box.

Second Embodiment

Figure 10:
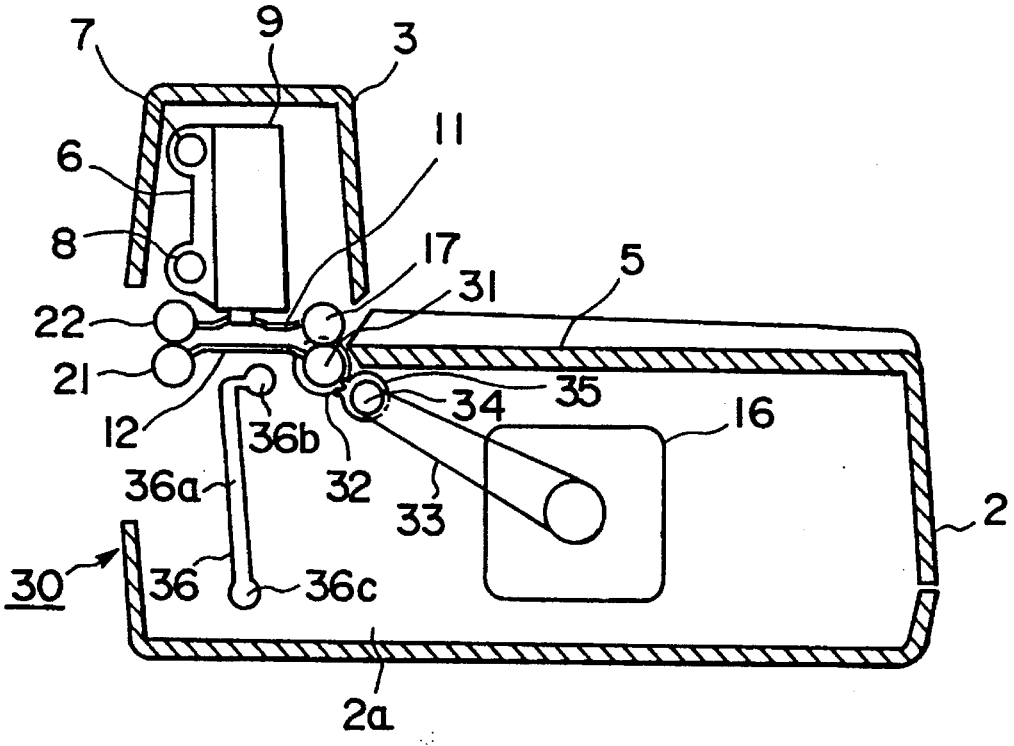
FIG. 10 is a schematic cross-sectional view of a printer according to a second embodiment of the invention when it is in a printing operation state.
Figure 11:
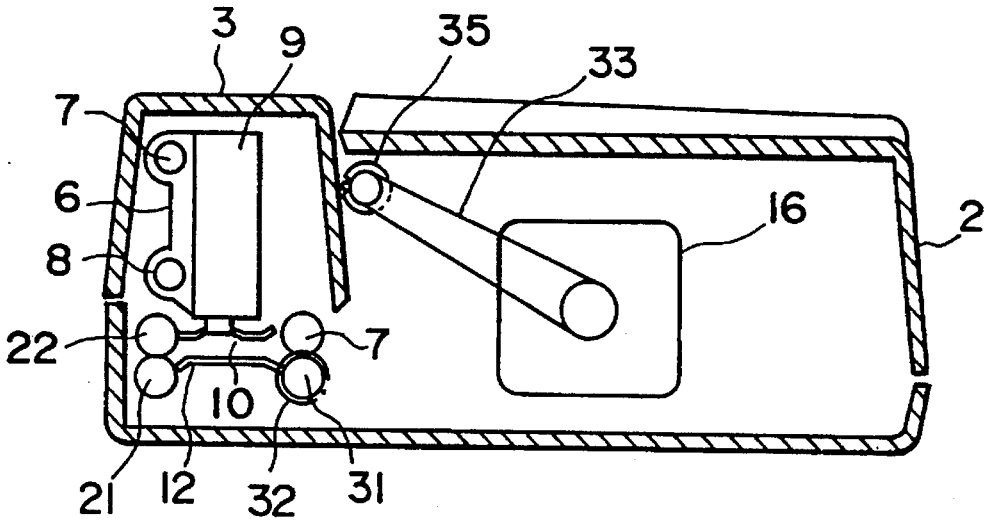
FIG. 11 is a schematic cross-sectional view of the printer according to the second embodiment of the invention when it is in a non-printing operation state.

FIGS. 10 and 11

A printer 1 of the second embodiment will be described with reference to FIGS. 10 and 11.

An internal structure of the printing unit 3 is substantially the same as the first embodiment. Accordingly, elements which are the same as those of the first embodiment are denoted at the same numerals and the explanations thereof are omitted.

A printer 30 comprises the printer body 2 and the printing unit 3 like the printer 1 of the first embodiment. The second embodiment is different from the first embodiment in respect of a driven gear 32 which is attached to a shaft, not shown, of a feed roller 31.

The feed motor 16 is provided inside the printer body 2. A drive gear 35 is integrally attached to a pulley 34. The drive gear 35 is disposed to mesh the driven gear 32. A belt 33 is entrained around the pulley 34 and a pulley, not shown, of the feed motor 16. Accordingly, the feed roller 31 is driven by the feed motor 16. Guide holes 36 are defined on side frames 2*a* of the printer body 2. Each of the guide holes 36 has a moving portion 36a, an upper retaining portion 36*b* and a lower retaining portion 36*c*. The moving portion 36*a* is bent substantially at right angles at the upper portion thereof. The printing unit 3 is attached to the printer body 2 so as to be movable along the guide holes 36.

Figure 12:
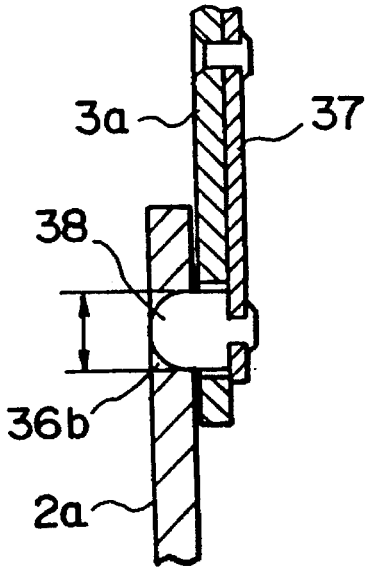
FIG. 12 is a partially enlarged view of a retaining mechanism in FIG. 10, showing how the retaining mechanism retains a printing unit on a printer body.

A retaining mechanism for retaining the printing unit 3 on the printer body 2 in a fixed state will be described with reference to FIG. 12.

The leaf spring 37 is fixed to the side frame 3*a* of the printing unit 3. The projection 38 is attached to the tip end of the leaf spring 37. The upper retaining portion 36*b* of the guide hole 36 has such a size that the projection 38 can engage therein. The lower retaining portion 36*c* has substantially the same size as the upper retaining portion 36*b*. When the projection 38 is retained by the upper retaining portion 36*b*, the printing unit 3 is in the printing operation state as illustrated in FIG. 10. When the projection 38 is retained by the lower retaining portion 36*c*, the printing unit 3 is in the non-printing operation state as illustrated in FIG. 11.

Figure 13:
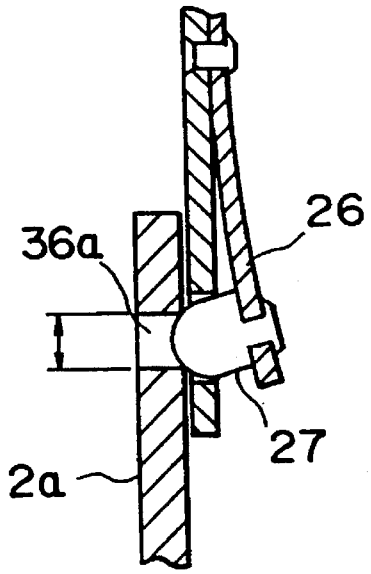
FIG. 13 is a partially enlarged view of a guiding mechanism in FIG. 10, showing how the guide mechanism guides a printing unit.

A guide mechanism for guiding the movement of the printing unit 3 will be described with reference to FIG. 13.

There are defined on the side frames 2*a* of the printer body 2 moving portions 36*a* of the guide holes 36 which are smaller than the projection 38 in the diameter thereof. Accordingly, the tip end of the projection 38 alone enters the moving portion 36*a* when the printing unit 3 moves.

When the printing unit 3 is accommodated inside the printer body 2 in the non-printing operation state, the printing unit 3 is displaced leftward in FIG. 10 (rearward of the printer) so that the projection 38 is got out from the upper retaining portion 36*b* of the guide hole 36. The projection 38 is thereafter moved along the moving portion 36*a*. With the moving of the projection 38, the drive gear 35 is released from the meshing with the driven gear 32. After the projection 38 passes through a substantially right angled portion of the moving portion 36*a*, the printing unit 3 moves downward. The projection 38 engages in the lower retaining portion 36*c*. With such an operation, the printing unit 3 is retained in the state as illustrated in FIG. 11. At this time, the printing unit 3 is accommodated in the printer body 2. Accordingly, the printer 30 is made compact like a box in the non-printing operation state. Since a control unit and a printing operation are the same as those of the first embodiment, explanations thereof are omitted.

Third Embodiment

Figure 14:
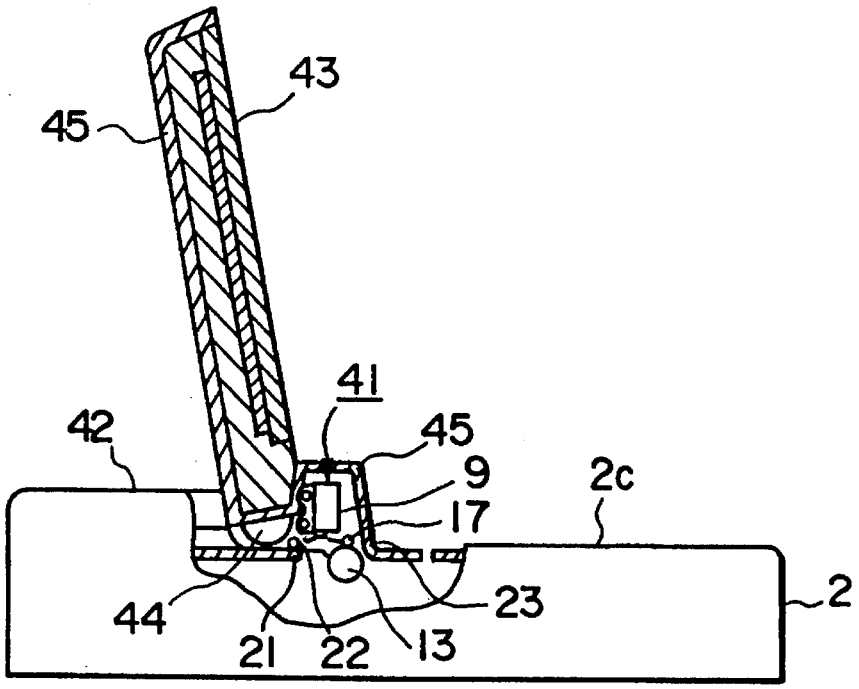
FIG. 14 is a partly cut side view of a printing unit of a data processing apparatus according to a third embodiment of the invention when it is in a printing operation state.
Figure 15:
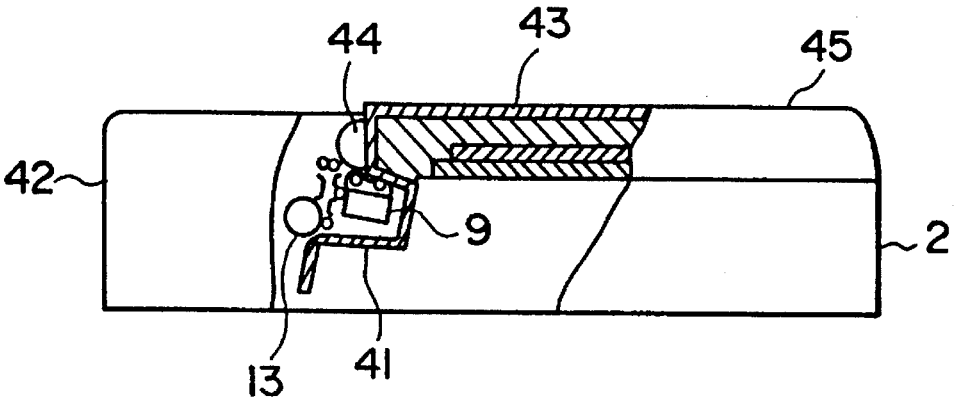
FIG. 15 is a partly cut side view of the printing unit of the data processing apparatus in FIG. 14 when it is in a non-printing operation state.

FIGS. 14 and 15

A data processing apparatus having a printing unit according to the third embodiment of the invention will be described with reference to FIGS. 14 and 15.

A data information apparatus 42 of the third embodiment has a printing unit 41. A display unit 43 is provided so as to be turned about a supporting portion 44. A cover 45 for covering the display unit 43 also serves as a cover of the printing unit 41 when the display unit 43 turns about the supporting portion 44. A structure of the printing unit 41 is the same as the printer 1 of the first embodiment. That is, the printing unit 41 has a paper feeding mechanism comprising the ink jet type print head 9, the first and second feed rollers 13 and 21, and the first and second pressure rollers 17 and 22.

When printing is to be started, the display unit 43 is set in the state as illustrated in FIG. 14. At this time, the paper feeding mechanism of the printing unit 41 is positioned at the height which is substantially the same as that of a front upper surface 2c of a body 2 of this apparatus. The printing paper is inserted from the inserting slit 23 of the printing unit 41. The thus inserted printing paper is printed by the print head 9.

When printing is completed, the display unit 43 is turned about the supporting portion 44 clockwise in FIG. 14 and it is closed as illustrated in FIG. 15. At this time, the printing unit 41 is accommodated inside the body 2. The cover 45 is locked inside the body 2 and is not opened. In such a manner, the printing unit 41 is completely covered together with the display unit 43 by the cover 45 so that the printing unit 41 can be protected. Since a control unit and a printing operation are the same as those of the first embodiment, explanations thereof are omitted.

Fourth Embodiment

Figure 16:
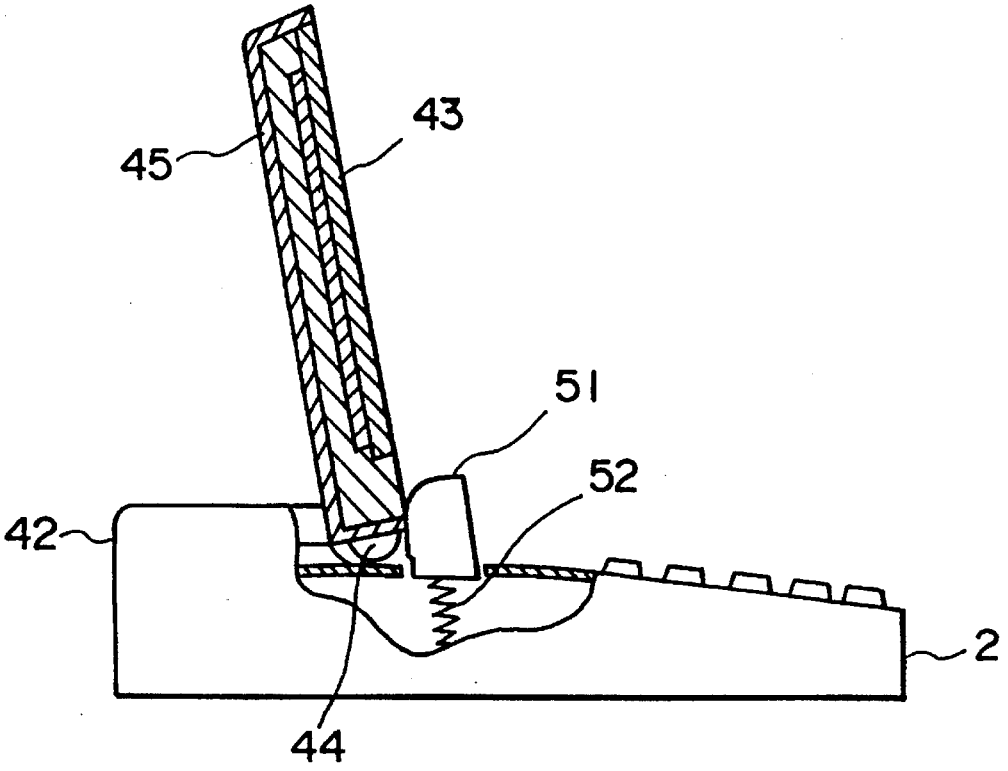
FIG. 16 is a partly cut side view of a printing unit of a data processing apparatus according to a fourth embodiment of the invention when it is in a printing operation state.
Figure 17:
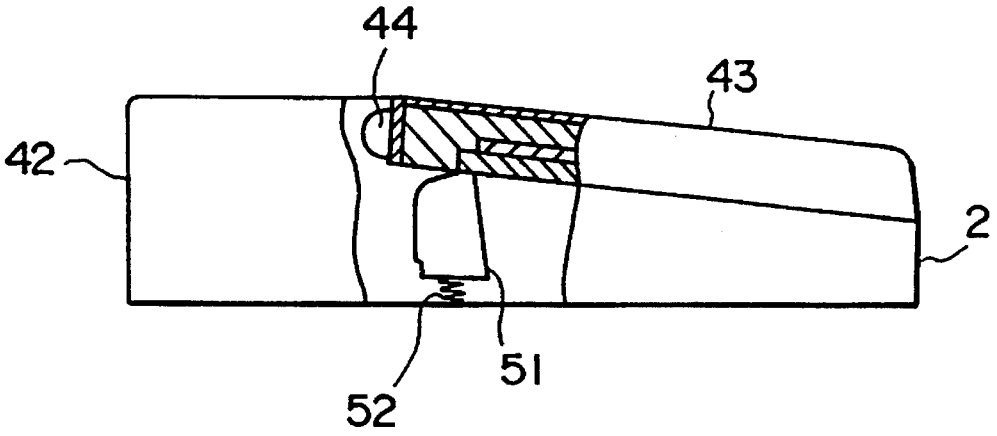
FIG. 17 is a partly cut side view of the printing unit of the data processing apparatus in FIG. 6 when it is in a non-printing operation state.

FIGS. 16 and 17

A data processing apparatus having a printing unit according to the fourth embodiment of the invention will be described with reference to FIGS. 16 and 17.

A data processing apparatus 42 of the fourth embodiment has a printing unit 51 like that of the third embodiment. However, the printing unit 51 is provided independently of the display unit 43. An internal structure of the printing unit 51 is the same as that of the third embodiment.

The printing unit 51 is always pushed upward by a spring 52 which is disposed inside the body 2. The printing unit 51 is retained by a retaining means, not shown, in the state as illustrated in FIG. 16 where the printing unit 51 is ready for printing when the printing unit 43 is opened (in the printing operation state).

When the display unit 43 is tuned about the supporting portion 44 in the non-printing operation state as illustrated in FIG. 16, the printing unit 51 is pushed upward by a part of a cover of the display unit 43 so that the printing unit 51 is accommodated inside the body 2. When the display unit 43 is locked while it is entirely closed, the printing unit 51 is accommodated inside and retained on the body 2. This state is illustrated in FIG. 17. Since a control unit and a printing operation are the same as those of the first embodiment, explanations thereof are omitted.

According to the third and fourth embodiments as set forth above, since the printing units which are provided in the data processing apparatus are switched to the printing operation state or an accommodation state involved in the opening or closing of the display unit 43, such switching operation can be automatically performed without operating the printing unit.

Although the print heads of the printers of the first and second embodiments and the print heads of the printing units of the third and fourth embodiments are explained as respectively ink jet type print heads, these print heads of the present invention are not limited to such ink jet type print heads.

What is claimed is:

1. A printer comprising:

a printer body having a body housing with an upper surface for supporting a printable sheet in a substantially horizontal plane, a drive roller with a shaft and a surface, and a drive means for driving the drive roller, the body housing rotatably supporting the drive roller below the horizontal plane with the surface of the drive roller being substantially tangential to the horizontal plane; and a printing unit having a print head for printing on the sheet and a driven roller with a shaft substantially parallel to the shaft of the drive roller and a surface, the printing unit being rotatable with respect to the shaft of the drive roller; and a supporting means for rotatably supporting the printing unit in a printing position in which the printing unit and print head are substantially above the horizontal plane and in a non-printing position in which the printing unit and print head are substantially below the horizontal plane, the printing unit in the printing position forming with the upper surface of the body housing a sheet insertion slit for receiving the sheet into the printing unit from the upper surface, the printing unit further having a sheet discharge slit for discharging the sheet, the sheet insertion slit and the sheet discharge slit being substantial coincident with the horizontal plane, the printing unit in the printing position situating the driven roller substantially above the horizontal plane with the surface of the driven roller being substantially tangential to the horizontal plane and pressing against the drive roller.

2. The printer of claim 1 wherein the printing unit further includes a printing unit housing rotatable with respect to the shaft of the drive roller, the supporting means comprising a first bearing on the body housing carrying the shaft of the drive roller and a second bearing on the printing unit housing also carrying the shaft of the drive roller.

3. The printer of claim 1 further comprising holding means for releasably holding the printing unit in the printing position and in the non-printing position, the holding means including:

a leaf spring having first and second ends, the leaf spring being affixed at the first end to one of the printing unit housing and the body housing adjacent one end of the shaft of the drive roller;

a projection extending from the second end of the leaf spring in a direction generally parallel to the shaft of the drive roller toward the other of the printing unit housing and the body housing, the leaf spring biasing the projection toward the other of the printing unit housing and the body housing, the projection having a generally hemispherical tip; and first and second catch apertures formed on the other of the printing unit housing and the body housing, the tip of the projection catching and engaging the first catch aperture when the printing unit is in the printing position and the second catch aperture when the printing unit is in the non-printing position, the printing unit being moved from one position to the other by an application of sufficient rotational force to cause the hemispherical tip of the projection to rise out of the respective catch aperture against the bias of the leaf spring.

4. A data processing apparatus comprising:

a printing unit including feeding means for feeding a printable sheet in a substantially horizontal plane and a print head for printing on the sheet;

a display unit including covering means and display means attached thereto, the display means for displaying data from a data processor;

an input body including an upper surface and a data inputting unit for inputting data to the data processor;

supporting means for rotatably supporting the display unit in an open position in which the display means is viewable and the data inputting unit is accessible and in a closed position in which the display means is non-viewable and the data inputting unit is non-accessible; and interlocking means for interlocking the display unit and the printing unit such that the printing unit and print head are substantially above the horizontal plane in a printing position for receiving the sheet through the feeding means from the upper surface of the input body when the display unit is in the open position, and such that the printing unit and print head are substantially below the horizontal plane in a non-printing position when the display unit is in the closed position, the feeding means being substantially above the horizontal plane with the print head being disposed in a first orientation when the printing unit is in the printing position, the feeding means being substantially below the horizontal plane with the print head being disposed in a second orientation at about a right angle with respect to the first orientation and the printing unit being substantially accommodated within the input body when the printing unit is in the non-printing position.

5. A data processing apparatus of claim 4 wherein the display unit and the printing unit are integrally formed.

* * * * *